United States Patent [19]

Osako

[11] 4,449,227

[45] May 15, 1984

[54] X-RAY APPARATUS

[76] Inventor: Teruaki Osako, 708 Chisan Mansion, 3-16, Naka-machi, Utsunomiya-shi, Tochigi-ken, Japan

[21] Appl. No.: 300,746

[22] Filed: Sep. 10, 1981

[30] Foreign Application Priority Data

Sep. 13, 1980 [JP] Japan ..... 55-127737

[51] Int. Cl.[3] ..... H05G 1/30

[52] U.S. Cl. ..... 378/112; 378/105

[58] Field of Search ..... 378/111, 112, 105

[56] References Cited

U.S. PATENT DOCUMENTS 3,432,737 3/1969 Hunter et al. .
3,737,755 6/1973 Calkin et al. .
3,818,308 6/1974 Tamari .
3,846,691 11/1974 Higgins .
3,863,131 1/1975 Muir .
4,295,049 10/1981 Ebersberger ..... 378/112

FOREIGN PATENT DOCUMENTS 2019655 3/1979 United Kingdom .

*Primary Examiner*—Craig E. Church
*Attorney, Agent, or Firm*—Cushman, Darby & Cushman

[57] ABSTRACT

An X-ray apparatus, after an AC output from an AC power source is rectified by a first rectifier circuit, supplies it to a primary winding side of a high-tension transformer through a bridge inverter. The bridge inverter includes first and second switching elements arranged at its first and second arms and operating as high-frequency choppers, a third switching element and first parallel circuit arranged at its third arm and forming a closed circuit together with the primary winding of the high-tension transformer, and a fourth switching element $Q_4$ and second parallel circuit arranged at its fourth arm and forming a closed circuit together with the primary winding of the high-frequency transformer, the first parallel circuit being connected in series with the third switching element and comprised of a diode and resistor and the second parallel circuit being connected in series with the fourth switching element and comprised of a diode and resistor. An energy stored in the primary winding of the high-tension transformer is released through the closed circuit. A high-voltage output induced in the secondary winding of the high-tension transformer is applied to the X-ray tube through a second rectifier circuit. A voltage applied to the X-ray tube is detected at a voltage detection circuit and controlled in the feedback control circuit. Control signals are supplied to the respective arms of the bridge inverter so that the voltage to be applied to the X-ray tube becomes a predetermined value.

2 Claims, 9 Drawing Figures

X-RAY APPARATUS

BACKGROUND OF THE INVENTION

This invention relates to a bridge inverter type X-ray apparatus, and in particular to an X-ray apparatus adopting a secondary winding side feedback control system, which permits feedback to the control system of high-frequency choppers in a bridge inverter by detecting a high voltage output from the secondary winding of a high-tension transformer.

A bridge inverter type X-ray apparatus is adapted to supply an AC output from an AC power source, after passing through a rectifier circuit, to a bridge inverter connected to a primary winding of a high-tension transformer. The bridge inverter is such that four switching elements are connected in a bridge configuration. In this bridge configuration, the two switching elements are connected in a closed circuit including the primary winding of the high-tension transformer and used as high-frequency choppers. When the switching elements are operated in a complementary fashion, high-voltage output is produced from the secondary winding of the high-tension transformer. The high-voltage output is applied to the X-ray tube through the rectifier circuit. It is necessary that the high-voltage output applied to the X-ray tube be stable and free from oscillations. For this reason, a conventional X-ray apparatus, as disclosed in Japanese Patent Application No. 55-108282, adopts what is called a primary winding side feedback system. That is, in the conventional X-ray apparatus, a voltage on the primary winding of the high-tension transformer is detected through a special filter and the detection output is fed back to the high-frequency choppers at a high load time. It has been impossible, however, to perform a feedback control with respect to having loads. A so-called secondary winding side feedback system or a cross regulation system is preferable in the control of high-voltage output applied to the X-ray tube. That is, a voltage on the secondary winding side is detected and the detection voltage is fed back to the control circuit of high-frequency choppers in the bridge inverter.

The secondary winding side feedback system, however, is not adapted for the reason as set out below.

That is, a high-tension cable is used which is shielded between the X-ray tube and a rectifier circuit for rectifying a high-voltage output on the secondary winding side of the high-tension transformer. An electrostatic capacitance is present between the shielded portion and the core conductor of the cable. The inverter elements are alternately conducted due to the coexistence of such electrostatic capacitance with the load impedance and leakage impedance of the high-tension transformer. In the initial portion of an exposure operation by the X-ray tube or when a high-voltage output on the secondary winding side of the high-tension transformer is switched from one polarity to another, "hunting" occurs, causing oscillation of a voltage applied to the X-ray tube and a resultant unstable voltage. "Hunting" also takes place by a possible excessive overshoot occuring during the initial portion of exposure. Even if, at this time, feedback control is effected with respect to the choppers by detecting a tube voltage across the X-ray tube, it has been impossible to obtain a stable voltage waveform to be applied to the X-ray tube.

SUMMARY OF THE INVENTION

It is accordingly an object of this invention to provide an X-ray apparatus which can effect feedback control with respect to high-frequency choppers in a bridge inverter by detecting an oscillation-free output on the secondary winding side of a high-tension transformer. In order to achieve this object, there is provided an X-ray apparatus, comprising an AC power source, a first rectifier circuit connected to the AC power source to rectify an AC input, a high-tension transformer connected to receive an output of said first rectifier circuit and to generate a high-voltage output to be supplied to the X-ray tube, a bridge inverter comprising first and second switching elements arranged at its first and second arms, forming a closed circuit together with the first rectifier circuit and primary winding of the high-tension transformer and adapted to operate as high-frequency choppers, a third switching element and first parallel circuit arranged at its third arm and forming a closed circuit together with the primary winding of the high-tension transformer, said first parallel circuit being connected in series with the third switching circuit and comprised of a diode and resistor, and a fourth switching element and second parallel circuit arranged at its fourth arm, said second parallel circuit being connected in series with the fourth switching element and constituted of a diode and resistor, a second rectifier circuit connected to a secondary winding of the high-tension transformer to rectify a high-voltage output on the secondary winding side of the high-tension transformer, an X-ray tube connected to the second rectifier circuit and adapted to receive a high-voltage output rectified by the second rectifies circuit, a voltage detection circuit connected to the X-ray tube and adapted to detect a voltage to be applied to the X-ray tube, and a feedback control circuit connected between the voltage detection circuit and the switching elements at the respective arms of said bridge inverter to receive a detection output detected by the voltage detection circuit and to supply, to the switching elements at the respective arms of the bridge inverter, control signals whereby the voltage applied to the X-ray tube becomes a predetermined value. According to the X-ray apparatus so arranged, parallel circuits each comprised of a diode and resistor are connected to the switching elements at the third and fourth arms of a bridge inverter i.e. a closed circuit portion of a stored energy release path of a leakage inductance in the primary winding of the high-tension transformer. By setting the resistors to predetermined values, "hunting" is prevented from occurring on the output of the secondary winding of the high-tension transformer. It is therefore possible to obtain a oscillation-free, stabilized waveform as a voltage to be applied to the X-ray tube. This permits secondary winding side feedback control.

DETAILED DESCRIPTION OF THE PREFERRED EMBODIMENTS

This invention will be explained below in more detail in connection with its embodiments.

Figure 1:
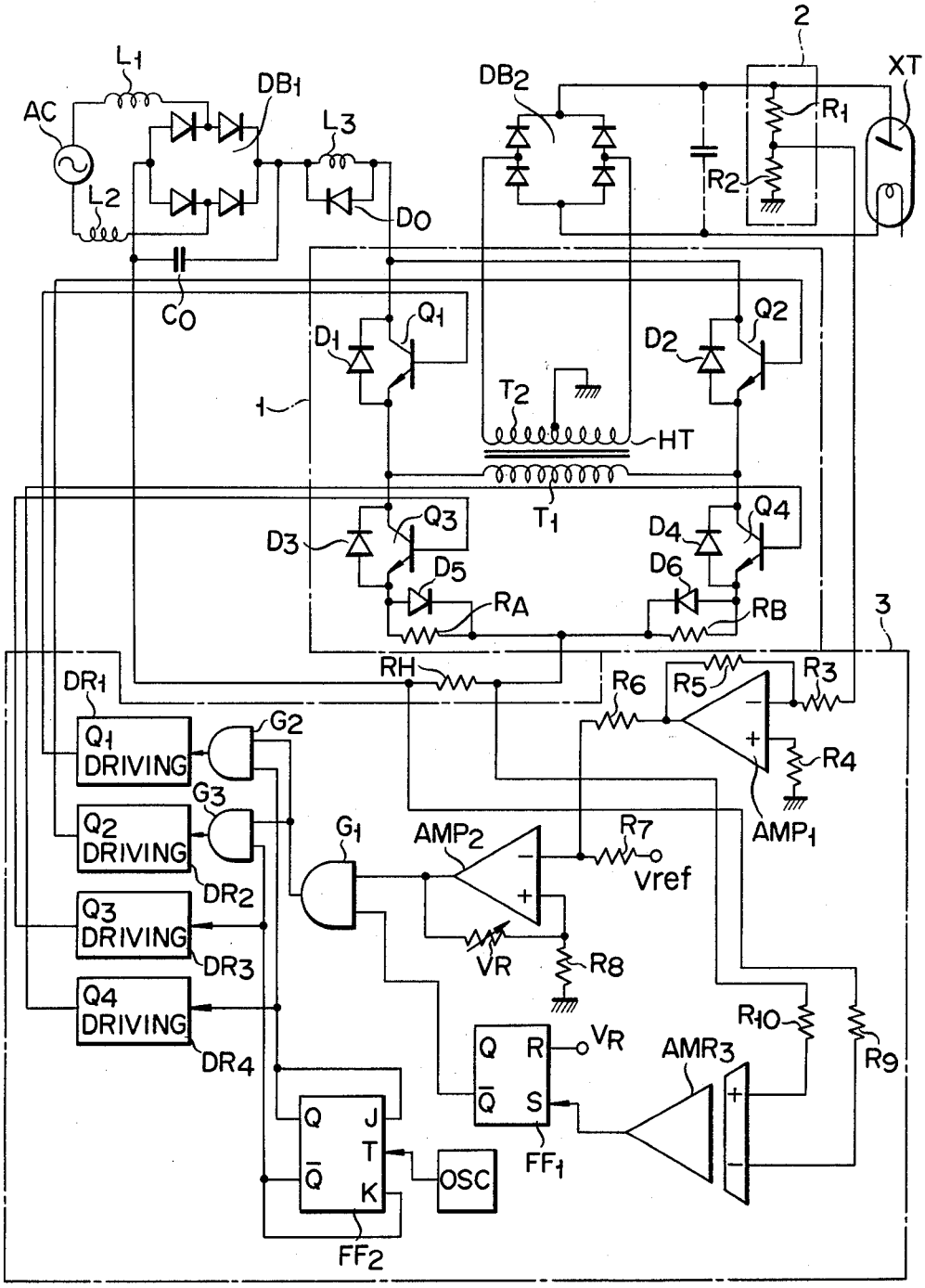
FIG. 1 is a block circuit diagram showing the embodiment of an X-ray apparatus of this invention.
Figure 2:
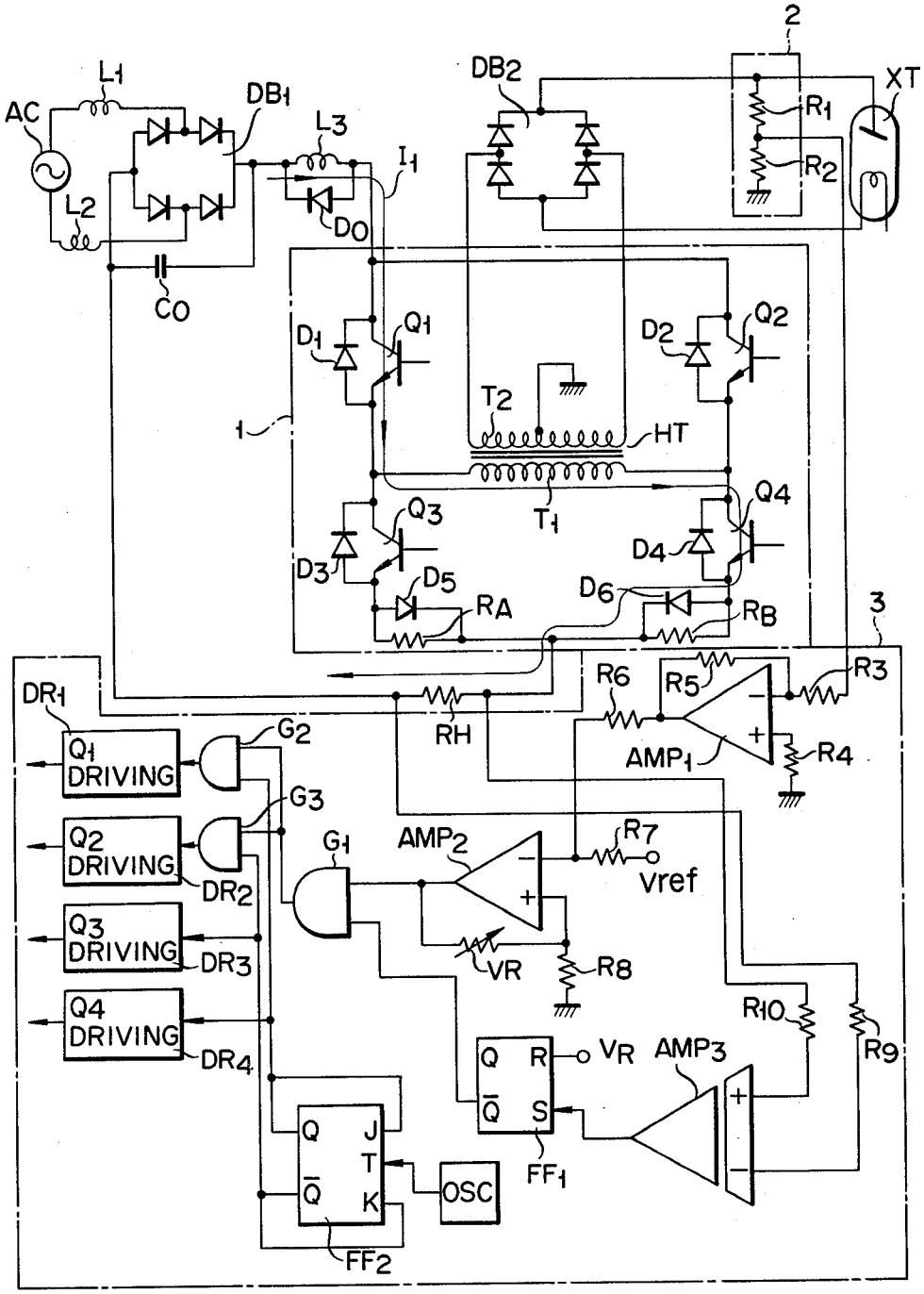
FIGS. 2 through 6 are views for explaining a flow of current at two different points of operation in the circuit of FIG. 1.

In the circuit of FIG. 1, choking coils $L_1$, $L_2$ are connected at one end between both terminals of an AC power source. The coils $L_1$ and $L_2$ are connected at the other end to a first rectifier circuit $DB_1$ of a diode bridge type. The positive terminal of the first rectifier circuit $DB_1$ is connected through a choking coil $L_3$ to a bridge circuit 1, while the negative terminal of the first rectifier circuit $DB_1$ is connected through an excess current detection resistor $R_H$ to the bridge circuit 1. A flywheel diode $D_0$ is connected in parallel with the choking coil $L_3$ and a smoothing capacitor $C_0$ is connected between the positive and negative terminals of the first rectifier circuit $DB_1$. The bridge circuit 1 comprises a parallel combination of a closed circuit including two NPN transistors $Q_1$, $Q_2$ and primary winding $T_1$ of a high-tension transformer HT and closed circuit including two NPN transistors $Q_3$, $Q_4$ and primary winding $T_1$ of the high-tension transformer HT. That is, these closed circuits are connected in parallel with the primary winding $T_1$ in common. Diodes $D_1$, $D_2$, $D_3$ and $D_4$ are connected in parallel to the transistors $Q_1$, $Q_2$, $Q_3$ and $Q_4$, respectively, with their polarity indicated. A series combination of a parallel circuit comprising a diode $D_5$ and resistor $R_A$ and parallel circuit comprising a diode $D_6$ and resistor $R_B$ is connected between the emitters of the transistors $Q_3$ and $Q_4$. Of these transistors $Q_1$ to $Q_4$, a pair of oppositely arranged transistors $Q_1$, $Q_2$ are used as high frequency choppers. A second rectifier circuit $DB_2$ of a diode bridge type is connected to a secondary coil $T_2$ of the high-tension transformer HT and an X-ray tube XT is connected to the output of the second rectifier circuit $DB_2$. A voltage detection circuit 2 comprised of voltage dividing resistors $R_1$ and $R_2$ (bleeder resistors) is connected to the positive terminal of the X-ray tube XT and the output of the voltage detection circuit 2 is inputted to a feedback control circuit 3. The feedback control circuit 3 comprises an operational amplifier $AMP_1$ connected to receive an output of the voltage detection circuit 2 to perform an impedance conversion, an error amplifier $AMP_2$ connected to receive a voltage corresponding to a sum of the output voltage of the operational amplifier $AMP_1$ and reference voltage $V_{ref}$ and having a variable resistor VT for positive feedback, an error amplifier $AMP_3$ connected to receive a voltage across the excess current detection resistor $R_H$ and having its output inverted to a high level when the voltage exceeds an allowable range, a reset preference type flip-flop $FF_1$ adapted to be set by a high output level of an error amplifier $AMP_3$ and reset by an interlock release signal $V_R$, an AND gate $G_1$ connected to receive a $\overline{Q}$ output signal of the flip-flop $FF_1$ and output of the error amplifier $AMP_2$, a J-K flip-flop $FF_2$ adapted to be triggered by an output of an oscillator OSC, to complementarily produce an output from its output terminals Q, $\overline{Q}$ and adapted to produce an output by properly frequency-dividing the output of an oscillator OSC, an AND gate $G_2$ connected to receive a Q output of the flip-flop $FF_2$ and output of the AND gate $G_1$, an AND gate $G_3$ connected to receive a $\overline{Q}$ output of the flip-flop $FF_2$ and output of the AND gate $G_1$, transistor drive circuits $DR_1$ and $DR_2$ connected to receive the outputs of the AND gates $G_2$ and $G_3$, respectively, and transistor drive circuits $DR_4$ and $DR_3$ connected to receive the Q and $\overline{Q}$ outputs, respectively. Of these transistor drive circuits, the transistor drive circuits $DR_1$ and $DR_2$ have their outputs connected to the bases of the chopper transistors $Q_1$ and $Q_2$, respectively, while the transistors $DR_3$ and $DR_4$ have their outputs connected to the bases of the transistors $Q_3$ and $Q_4$, respectively.

The operation of the circuit arrangement as mentioned above will be explained below by referring to not only FIG. 1, but also FIGS. 2 to 8.

When a power source switch, not shown, is closed, the oscillator OSC in the feedback control circuit 3 is operated. When a frequency output is produced from the output terminal Q of the J-K flip-flop $FF_2$, the corresponding transistor drive circuits $DR_1$ and $DR_4$ are operated to produce transistor drive outputs as indicated in a time chart in FIG. 7. When a frequency output is produced from the output terminal $\overline{Q}$ of the J-K flip-flop $FF_2$, the corresponding transistor drive circuits $DR_2$ and $DR_3$ are operated to produce transistor drive outputs as indicated in the time chart in FIG. 7. That is, pulse signals $P_1$ and $P_2$ having their phases reversed with respect to each other and including high-frequency pulses in a predetermined width $T_1$ are produced from the chopper transistor drive circuits $DR_1$ and $DR_2$, while pulse signals $P_3$ and $P_4$ having their phases reversed with respect to each other and including a predetermined width $T_1$ are produced from the transistor drive circuits $DR_3$ and $DR_4$. Here, the pulse $P_4$ and envelope waveform of the pulse $P_1$ substantially coincide with each other, and the pulse $P_3$ and envelope waveform of the pulse $P_1$ substantially coincide with each other. The transistor drive circuits $DR_1$ and $DR_2$ are controlled by the output signals (the output signal of the error amplifier $AMP_2$) of the AND gates $G_2$ and $G_3$, respectively, and operated so as to cause a variation of a time ratio of the high-frequency pulses of the output pulse signals $P_1$ and $P_2$.

Since the transistors $Q_1, \ldots Q_4$ in the bridge circuit 1 are driven by the pulses $P_1, \ldots,$ the circuit performs such an operation as mentioned below. When the transistor $Q_1$ is turned OFF and transistor $Q_2$ is turned ON with the transistor $Q_3$ OFF and $Q_4$ ON (time $t_1$ to $t_2$ in FIG. 7), a current $I_1$ flows from the positive terminal of the first rectifier circuit $DB_1$ through the choking coil $L_3$, chopper transistor $Q_1$, primary winding $T_1$ of the high-voltage transformer HT, transistor $Q_4$, diode $D_6$ and excess current detection resistor $R_H$ to negative terminal of the rectifier circuit $DB_1$ (see FIG. 2). As a result, a high voltage output is obtained from the secondary winding $T_2$ of the high-voltage transformer HT and a DC output of high voltage is applied to the X-ray tube XT to permit X-ray exposure. The tube voltage Ep when the X-ray exposure is started is given below.

$$Ep = nE\left\{ -e^{-\alpha t}\left(\cos\beta t + \frac{\alpha}{\beta}\sin\beta t\right) + 1 \right\} \quad (1)$$

$\alpha$, $\beta$ in Equation (1) are rewritten by the following equations (2) and (3).

$$\alpha = -\frac{1}{2RC} \quad (2)$$

-continued $$\beta = \sqrt{\frac{1}{LC} - \frac{1}{4R^2C^2}} \quad (3)$$

where

R: the internal impedance of the X-ray tube

C: the capacitance of a high-tension cable with respect to ground

Figure 3:
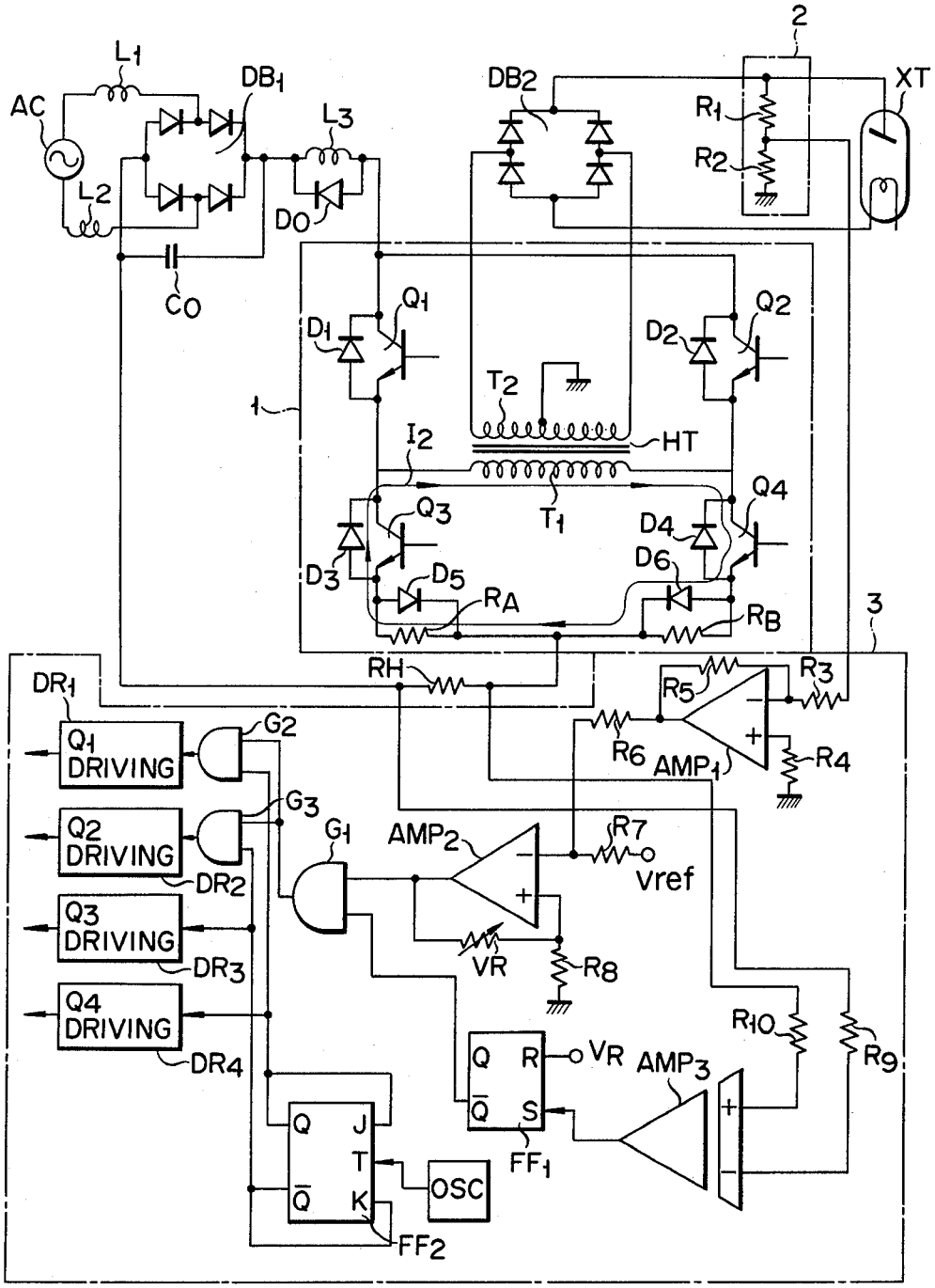
Figure 8:
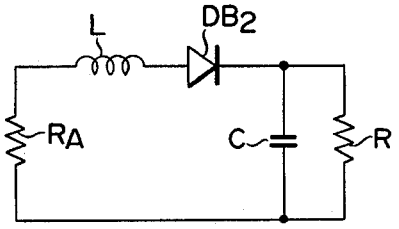
FIG. 8 is an equivalent circuit when a resistor is connected to a voltage supply circuit for supplying a voltage to an X-ray tube.

L: a sum L of the inductance of the coil $L_3$ and leakage inductance of the high-voltage transformer If the switching cycle of the chopper transistor $Q_1$ is made sufficiently smaller than 800μ seconds with $1/\alpha$ set at 800 μsec at minimum and $\beta/2\pi$ set at about 2 msec., the tube voltage Ep shows a "constantly raised" state when the transistor $Q_1$ is in the "ON" state.

Where the transistor $Q_1$ is rendered momentarily OFF with the transistor $Q_4$ ON (at the time of fall of the high-frequency pulse of the pulse signal $P_1$ (FIG. 7) at times $t_1$ to $t_2$), a current $I_2$ flows from the primary coil $T_1$ of the high-voltage transformer HT, through the transistor $Q_4$, diode $D_6$, resistor $R_A$ and diode $D_3$ back to a primary winding $T_1$ of the high-voltage transformer HT, as shown in FIG. 3. In this way, an energy stored in a leakage inductance in the primary winding $T_1$ of the high-voltage transformer HT is released. At this time, the equivalent circuit is as shown in FIG. 8 and, when the value of the resistor $R_A$ is so selected as to satisfy a relation of the following equation, the fall in the peak value level of a high-voltage output becomes a monotone decreasing function.

$$\frac{1}{R^2C^2} - \frac{2R_A}{HCL} + \frac{R_A^2}{L^2} - \frac{4}{CL} \geqq 0 \quad (4)$$

Thus, it is possible to obtain an oscillation-free circuit.

Figure 4:
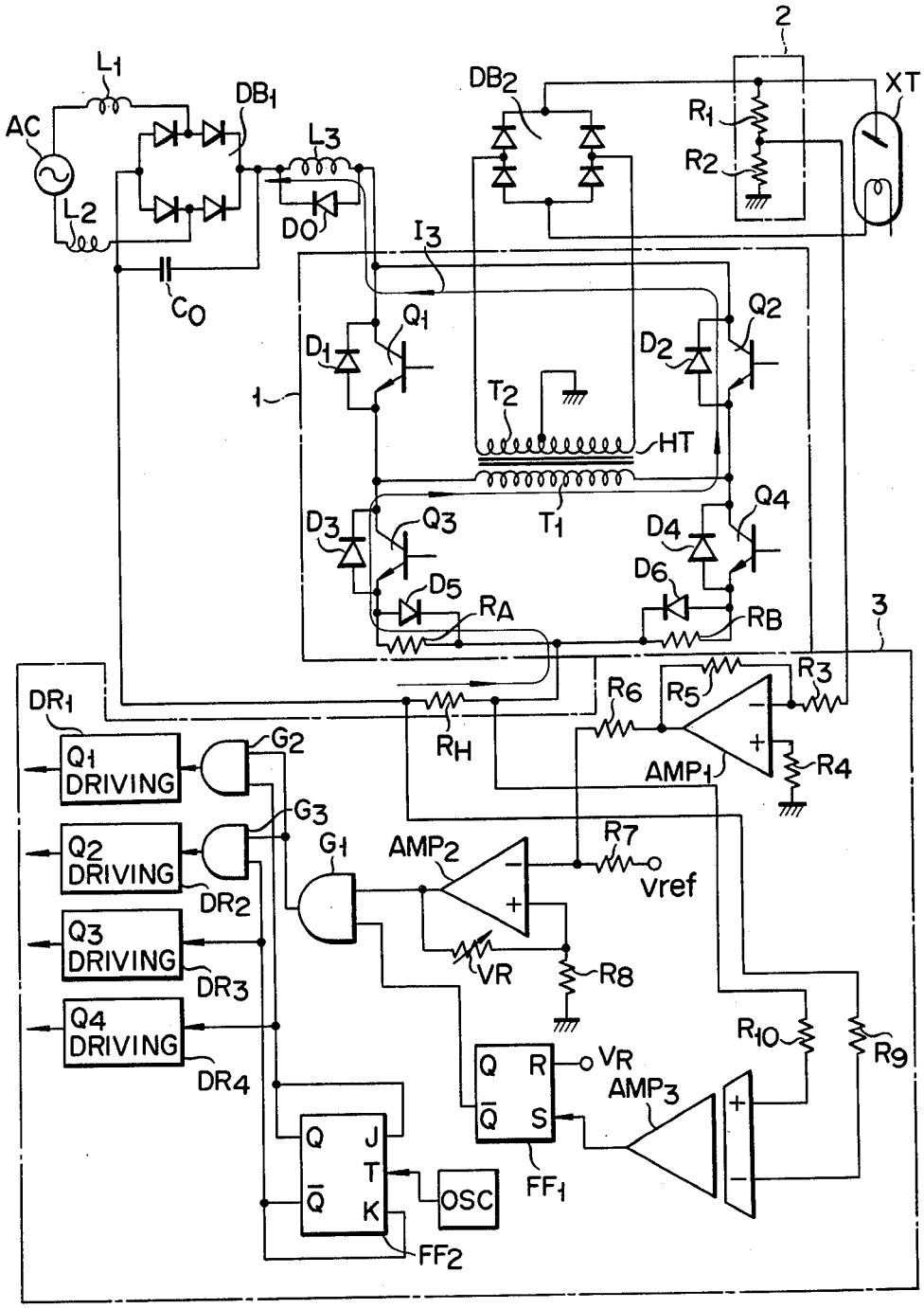
Figure 5:
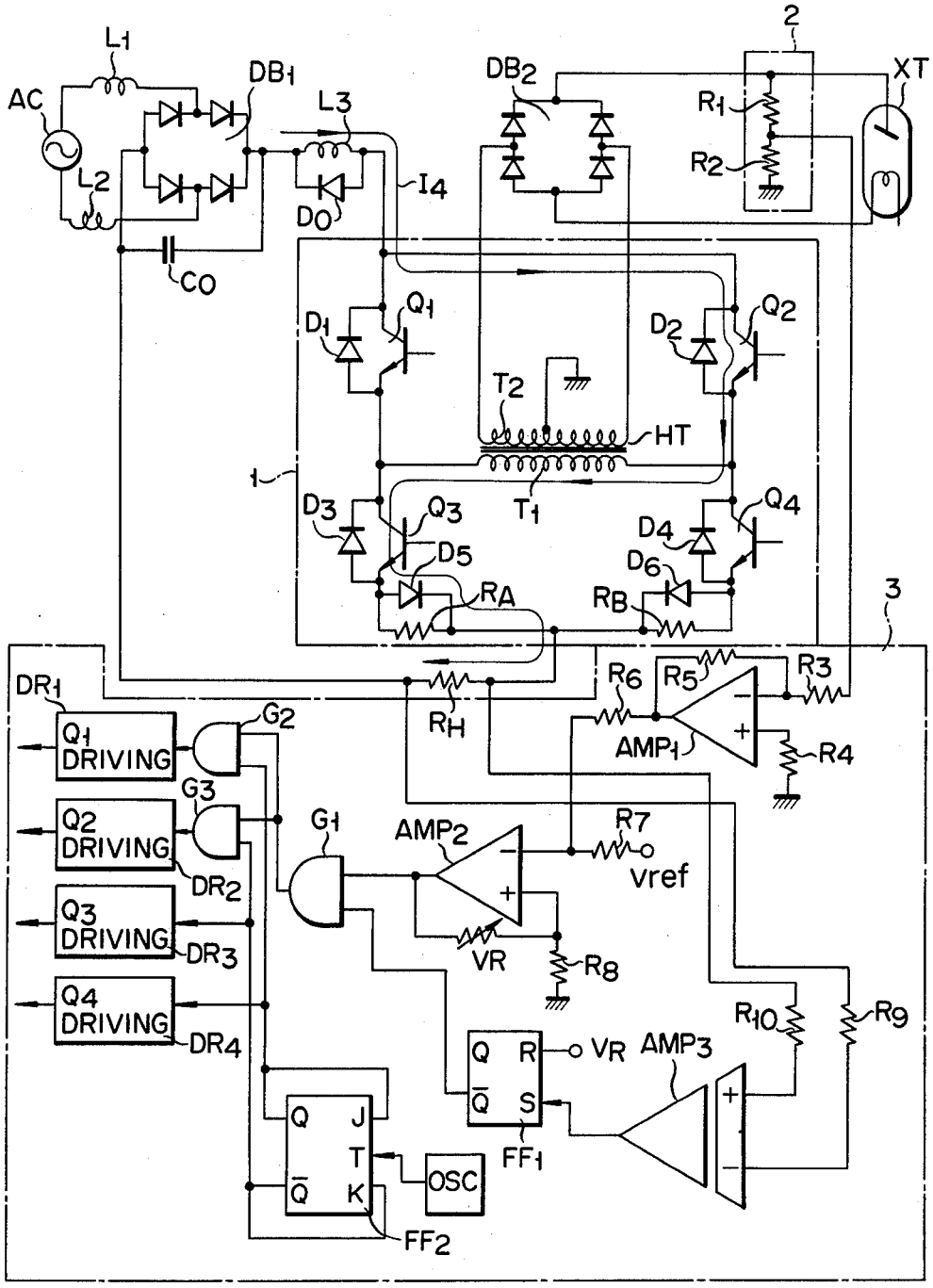
Figure 6:
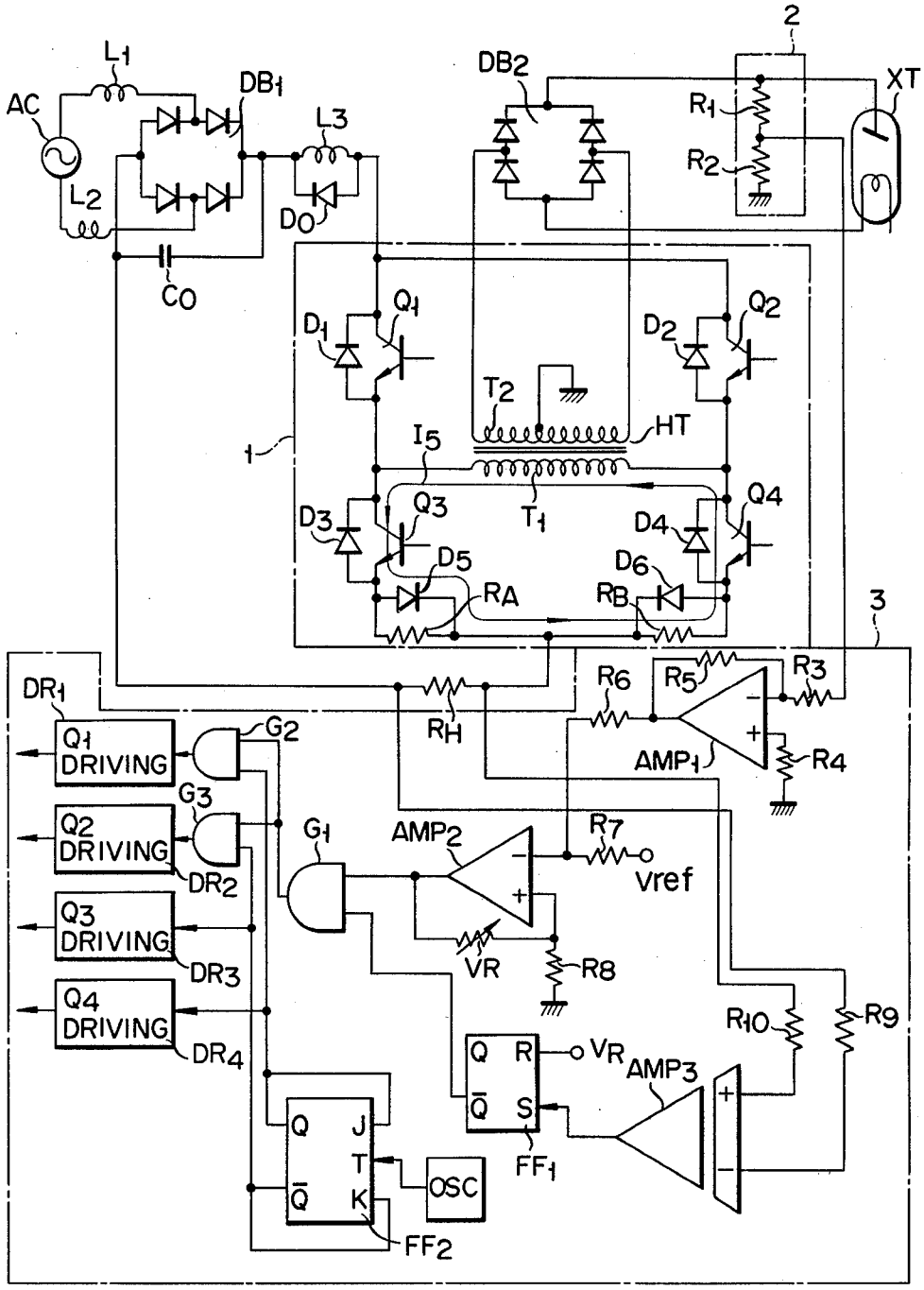
Figure 7:
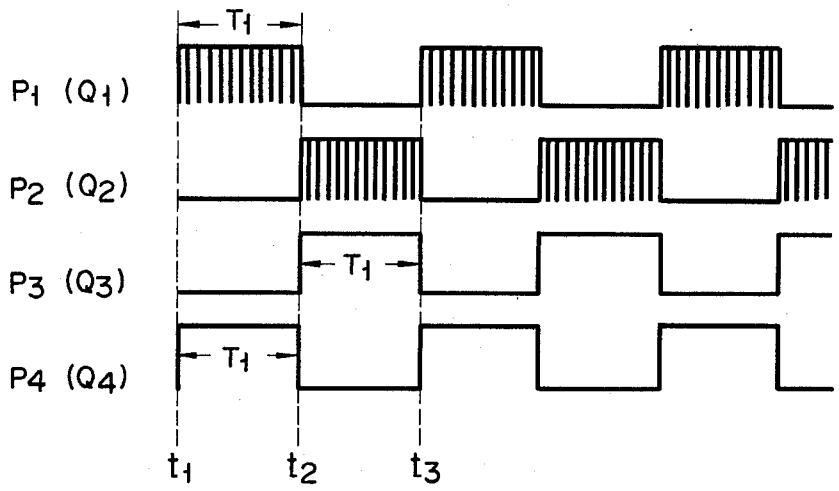
FIG. 7 is a time chart for explaining the operation of the circuit of FIG. 1.

When the phase switching is effected as the inverter operation i.e. the transistors $Q_1, \ldots, Q_4$ are rendered OFF, a current $I_3$ flows from the negative terminal of a first rectifier circuit $DB_1$ through an excess current detection resistor $R_H$, resistor $R_A$, diode $D_3$, primary winding $T_1$ of the high-tension transformer HT, diode $D_2$ and flywheel diode $D_0$ to the positive terminal of the first rectifier circuit $DB_1$ as shown in FIG. 4. An energy stored in the leakage inductance portion of the high-tension transformer HT is, while partially dissipated at the resistor $R_A$ and load (X-ray tube, recovered at the power source AC side. When this recovery is completed, then the transistors $Q_2$ and $Q_3$ are rendered conductive, permitting a smooth phase switching of the current. That is, when the phase switching occurs, a current $I_4$ flows into an excess current detection resistor $R_H$ through the choking coil $L_3$, transistor $Q_2$, primary winding $T_1$ of the high-tension transformer HT, transistor $Q_3$ and diode $D_5$, as shown in FIG. 5, and a high-voltage output developed at the secondary winding $T_2$ is applied through the second rectifier circuit $DB_2$ to the X-ray tube XT, permitted X-ray exposure. When the transistor $Q_2$ is rendered momentarily OFF, a current $I_5$ flows into the diode $D_4$ through the primary winding $T_1$ of the high-tension transformer $T_1$, transistor $Q_3$, diode $D_5$ and resistor $R_B$, as shown in FIG. 6, and, in this way, the stored energy is released. Even at this time, the equivalent circuit as shown in FIG. 8 is obtained. If the transistor $R_B$ is set to the same value as that of the resistor $R_A$, it is possible to obtain an oscillation-free circuit.

Such operation is repeated, permitting the inverter operation to be performed for X-ray exposure.

Figure 9:
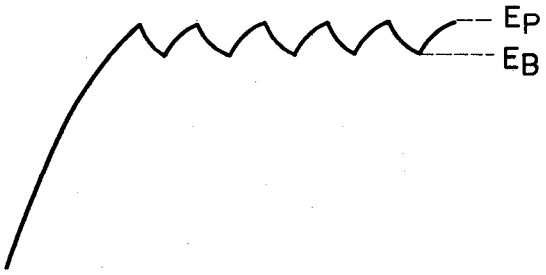
FIG. 9 is a tube voltage waveform circuit for explaining the operation of a second winding side feedback control system.

The operation of the feedback control circuit 3 will be explained below. The tube voltage of the X-ray tube XT at the inverter operation time is detected by the voltage detection circuit 2 and the detection output is inputted to the error amplifier $AMP_2$ through the amplifier $AMP_1$. The error amplifier $AMP_2$ has a hysteresis characteristic and two threshold voltages i.e. an upper limit value Ep and lower limit value $E_B$ of the tube voltage waveform as shown in FIG. 9. The transistor $Q_1$ or $Q_2$ remain conductive until the tube voltage reaches the upper limit value Ep, prompting a rise of the tube voltage. When the upper limit value Ep is reached, the transistor $Q_1$ or $Q_2$ become nonconductive, causing the tube voltage to be lowered. When the tube voltage reaches the lower limit value $E_B$, the transistor $Q_1$ or $Q_2$ becomes again conductive and the drive circuits $DR_1$, $DR_2$ are so controlled as to increase the tube voltage. In this way, the high-voltage output is stabilized.

When an excess current flows through the circuit during the operation of the X-ray apparatus, it is detected by the excess current detection resistor $R_H$. Since the output of the error amplifier $AMP_3$ is inverted to a high level, the flip-flop $FF_1$ is set to produce a $\overline{Q}$ output signal. As a result, the gate of the AND gate $G_1$ is closed, causing the control circuit to be interlocked for safty. In order to release such interlocking, it is only necessary to supply an interlock release signal $V_R$ to the reset terminal of the flip-flop $FF_1$.

This invention is not restricted to the above-mentioned embodiment and can be modified in a variety of ways. As the feedback control means, for example, use may be made of a comparator having a hysteresis characteristic. The switching transistors $Q_3$, $Q_4$ may be replaced by a GTO (gate turn-on thyristor). The excess current detection section may be omitted, because it provides no direct influence to this invention.

What is claimed is:

1. An X-ray apparatus comprising:

an alternating current (AC) power source;

a first rectifier circuit connected to the AC power source to cause an alternating current input to be rectified;

a high-tension transformer connected to receive an output of said first rectifier circuit and generate a high-voltage output;

a bridge inverter comprising:

first and second switching elements coupled to said first rectifier circuit and arranged in first and second arms of said inverter, forming a closed circuit together with a primary winding of said high-tension transformer and each adapted to operate as a high-frequency chopper, a third switching element and first parallel circuit arranged at a third arm of said inverter, said first parallel circuit being connected in series with said third switching element and comprised of a diode and resistor having a resistance value which causes energy accumulated in said primary winding to be dissipated at a steady, gradual pace when the polarity of said bridge inverter is reversed, and a fourth switching element and second parallel circuit arranged in a fourth arm of said inverter, said second parallel circuit being connected in series with said fourth switching element and comprised of a diode and resistor having a resistance value which causes energy accumulated in said primary winding to be dissipated at a steady, gradual pace when the polarity of said bridge inverter is reversed, said third and fourth arms being coupled to said first rectifier circuit and forming a closed circuit with said primary winding;

a second rectifier circuit connected to a secondary winding of said high-tension transformer to rectify a high-voltage output from the secondary winding;

an X-ray tube connected to said second rectifier circuit and adapted to receive said high-voltage output rectified by said rectifier circuit;

voltage detection means connected to said X-ray tube to detect said high-voltage which is applied to the X-ray tube; and feedback control means, connected between said voltage detection means and said switching elements at the arms of said bridge inverter, for receiving an output detected by said voltage detection means and for controlling each of said switching elements in such a way that said detected output is between predetermined upper and lower limits to cause said high-voltage output applied to said X-ray tube to become a predetermined value.

2. An X-ray apparatus according to claim 1, wherein:

said apparatus further includes a choking coil connected to said primary winding and a high-tension cable connected between said second rectifier and said X-ray tube; and said resistors of said first and second parallel circuits are set to such values as to satisfy the following equation:

$$\frac{1}{R^2C^2} - \frac{2R_A(\text{or } R_B)}{RCL} + \frac{R_A^2(\text{or } R_B^2)}{L^2} - \frac{4}{CL} \geqq 0$$

where

R: the internal impedance of the X-ray tube

C: the capacitance of said high-tension cable with respect to ground

L: an inductance corresponding to a sum of the inductance of said choking coil and leakage inductance of the high-tension transformer $R_A$, $R_B$: said resistors of said first and second parallel circuits.

* * * * *

UNITED STATES PATENT AND TRADEMARK OFFICE

CERTIFICATE OF CORRECTION

PATENT NO. : 4,449,227

DATED : May 15, 1984

INVENTOR(S) : OSAKO, T.

It is certified that error appears in the above-identified patent and that said Letters Patent is hereby corrected as shown below: Title page:

The assignee should be shown as: TOKYO SHIBAURA DENKI KABUSHIKI KAISHA.

Signed and Sealed this

*Eighteenth* Day of *March 1986*

[SEAL]

*Attest:*

DONALD J. QUIGG

*Attesting Officer*

*Commissioner of Patents and Trademarks*